US005132885A

United States Patent [19]

Hocheim et al.

[11] Patent Number: 5,132,885

[45] Date of Patent: Jul. 21, 1992

[54] PORTABLE FLUORESCENT LIGHTING SYSTEM

[75] Inventors: Frieder K. Hocheim; Gary H. Swirk, both of Los Angeles, Calif.

[73] Assignee: Kino Flo, Inc., Sun Valley, Calif.

[21] Appl. No.: 621,213

[22] Filed: Nov. 29, 1990

[51] Int. Cl.[5] ..... F21L 3/00

[52] U.S. Cl. ..... 362/217; 362/760; 362/352; 362/362; 439/232

[58] Field of Search ..... 362/3, 16, 17, 18, 217, 362/260, 277, 285, 287, 288, 319, 322, 427, 429, 430, 352, 362; 439/232, 226, 233, 235, 242

[56] References Cited

U.S. PATENT DOCUMENTS

| | | | |
|---|---|---|---|
| 3,852,582 | 12/1974 | Lowell | 362/11 |
| 4,669,033 | 5/1987 | Lee | 362/217 |
| 4,782,428 | 11/1988 | Lowell et al. | 362/3 |
| 4,814,958 | 3/1989 | Hsieh | 362/217 |

FOREIGN PATENT DOCUMENTS

| | | | |
|---|---|---|---|
| 1280818 | 11/1961 | France | 362/217 |

*Primary Examiner*—Richard R. Cole

*Attorney, Agent, or Firm*—Blakely, Sokoloff, Taylor & Zafman

[57] ABSTRACT

A portable fluorescent lighting system comprises an extremely lightweight corrugated plastic panel made into five subpanels by removing two flutes of the corrugation out to provide for hinging. At each end of each subpanel an oval shape channel is attached such that a deformable and form retaining shaft may be inserted for the purpose of preventing the subpanels to revert back to their original positions and remain in the desired configuration. Each oval channel is fixed to the subpanels to allow for a gap equal to no less than the hinge area created by removal of the flutes. The oval channel is larger than the form retaining wire to allow for a floating fit and for easy replacement in the event of shaft breaking. At least one elongate fluorescent light source is placed on the center subpanel and other four subpanels are used to control the direction of or limit the output of the fluorescent light as well as act as an enclosure box. The invention utilizes a locking lamp holder for firmly holding onto the pins of the fluorescent lamp and also feeding power to said lamp via a remote ballast and protable wire lamp harness outside the lighting system. In order to easily mount or hold the lighting system in place at any desired location and allow the system to be easily oriented in different directions, the lighting system utilizes a mounting device comprising a holding plate which consists of a ball and socket swiveling device to pivot and direct the position of the system. The holding plate is removably coupled, via a pair of "Nylatch" push-pin fasteners, to a mating plate which is attached to the rear of the center subpanel. The holding plate is mounted or held in place by a conventional motion picture stand called a "Century Stand" designed to hold flags and cutters.

37 Claims, 4 Drawing Sheets

FIG. 11
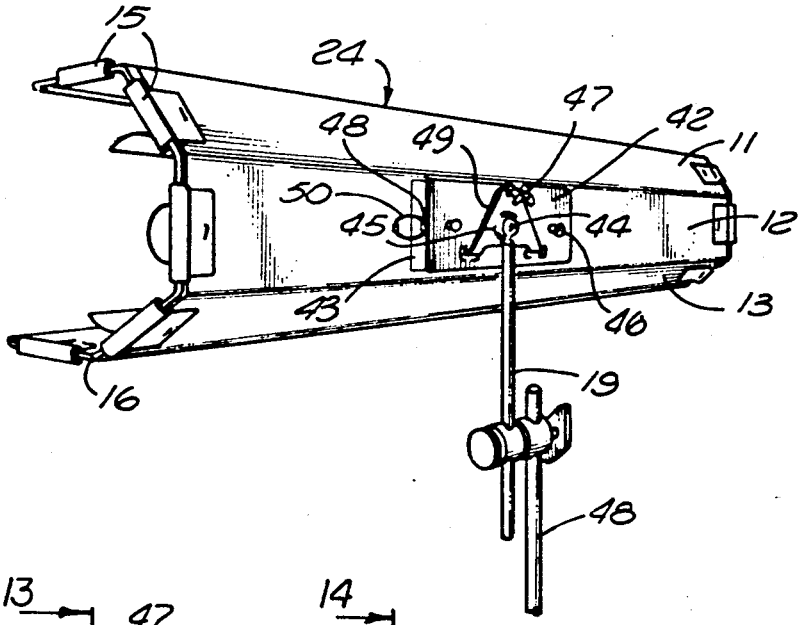
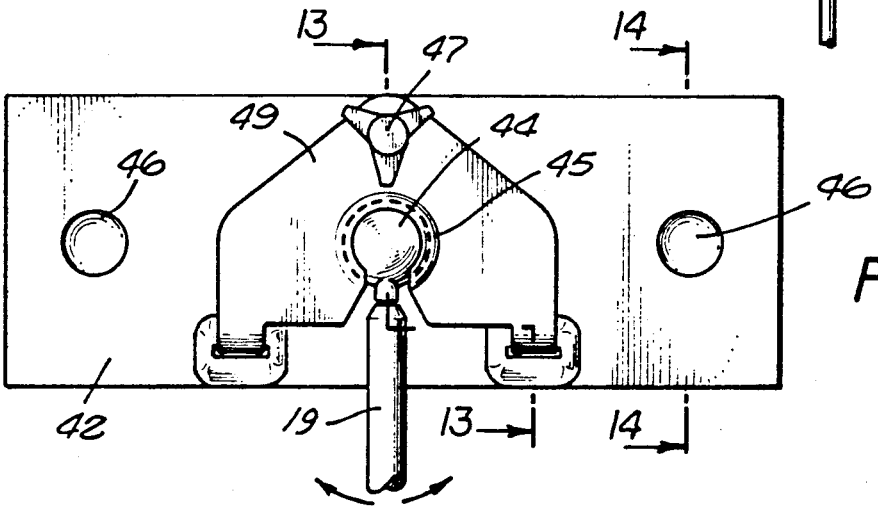
FIG. 12
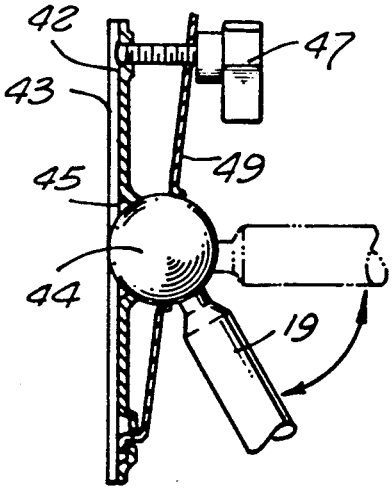
FIG. 13
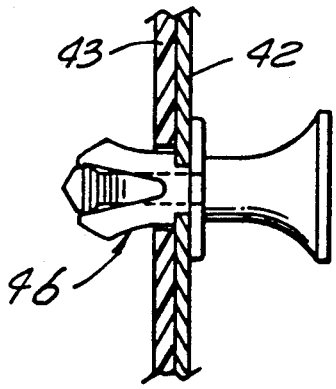
FIG. 14

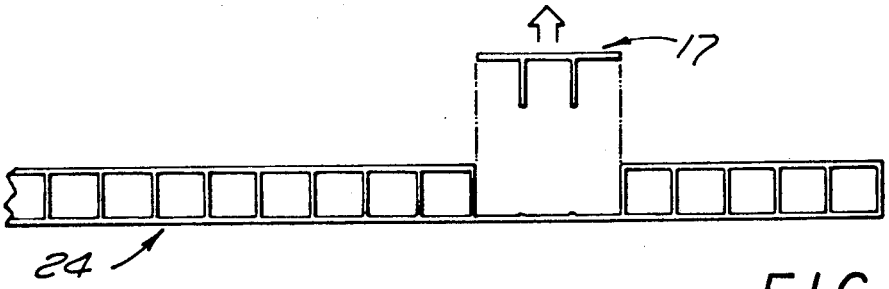
FIG. 3
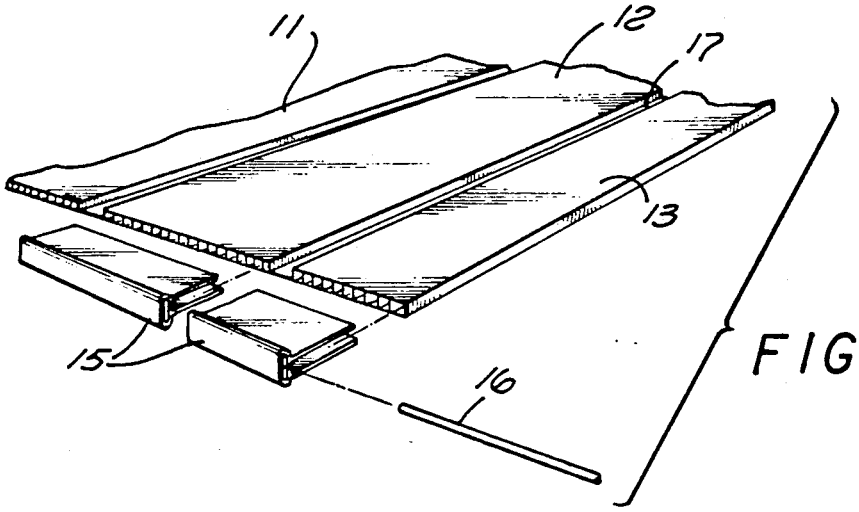
FIG. 4
FIG. 5
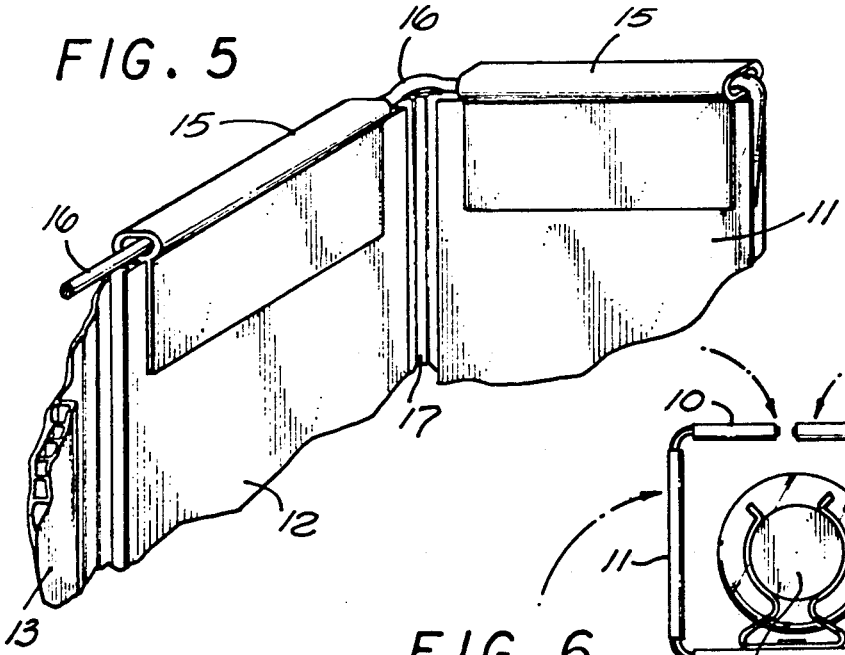
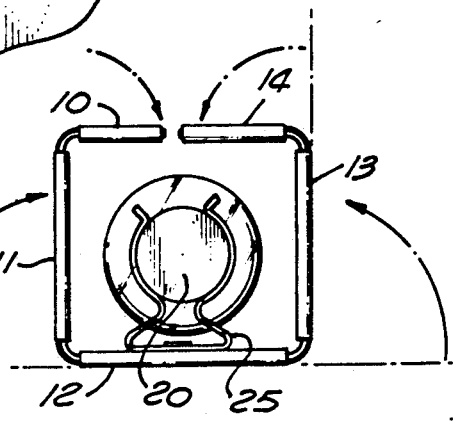
FIG. 6

PORTABLE FLUORESCENT LIGHTING SYSTEM

BACKGROUND OF THE INVENTION

1. Field of the Invention

This invention relates to a portable and lightweight fluorescent lighting system suitable for use in the field of photography, television and motion pictures utilizing fluorescent lamps.

2. Description of the Prior Art

Proper lighting is of great importance with respect to photography, television and motion pictures. There are a variety of lighting systems designed for use in connection with such industries. However, most such lighting systems are heavy and bulky and not easily transportable.

Originally film and television productions were made in studios and, therefore, the weight, size and portability of lighting devices were not of concern. Recently, however, an increasing majority of films are shot on location away from studios and, therefore, need lightweight, small and portable lighting systems which are also versatile and can easily be mounted in convenient and desirable positions or locations.

There have been improved lighting systems which are lighter and more compact than the ones used in film studios. For example, in Lowell, U.S. Pat. No. 3,852,582, a lighting device is disclosed comprising a luminaire, including a reflector mounting on elongated incandescent tubular lamp with mounting means to support said lighting device. However, the present invention is lighter and much more compact and, therefore, more suitable for location filming than the system taught by Lowell. Moreover, the present invention comprises a fluorescent lamp for softer and more efficient lighting as opposed to the incandescent lamps used in Lowell. The mounting device utilized in the present invention is highly adaptable to any desired location or position. Unlike other fluorescent lighting fixtures wherein the ballast is installed on the body of the fixture, adding extra weight and bulk to the fixture, the present invention utilizes a simple wire harness to carry power from a remote ballast to the lampholder, thereby reducing the weight and bulk of the light fixture and allowing for greater flexibility. This reduction in weight and size provides for the lighting system to be hidden in a place requiring of a little more than a diameter of a fluorescent lamp.

The present invention utilizes an extremely lightweight corrugated panel for supporting the fluorecent lamp. The corrugated panel is made of polypropylene which has good high and low temperature stability characteristics. By cutting and removing two flutes of corrugation out from the panel at four predetermined points, the panel is subdivided into five subpanels which can easily be hinged and additionally be used to control the direction or limit the output of the light as well as act as an enclosure for the lighting system for storage and transportation purposes. At each end of the panel an oval shaped channel is attached such that a deformable and a form retaining shaft may be easily inserted and removed from the oval shaped channel. This form retaining shaft allows the subpanels to flexibly remain in a desired configuration. The oval channel allows for easy removal and replacement of the form retaining shaft such that in cases of metal fatigue resulting in shaft breakage, a new shaft can be inserted without having to replace the complete hinging mechanism or the lighting system itself. In this connection, the oval shaped channel and form retaining shaft should not form a tight fit to avoid premature breakage of the shaft due to metal fatigue.

Traditional fluorescent light fixtures, in order to support the fluorescent lamp, utilize a lamp holder which has to be attached to the fixture for the needed support. By way of contrast, the present invention uses a locking lamp holder which is supported by the fluorescent lamp itself and is not dependent on any fixture. Furthermore, traditional lamp holders hold the pins of a fluorescent lamp by means of a friction fit which is not a firm hold and the lamp frequently disengages from the holder during handling. In contrast, the present invention utilizes a novel spring loaded locking lamp holder which firmly holds the fluorescent lamp without the support of a fixture while providing for electrical contact with the lamp.

The lighting system utilizes a mounting device which comprises a holding plate working on a ball and socket principle as opposed to the traditional yoke used to pivot and direct the position of the system. The holding plate is removably coupled, via a pair of "Nylatch" push-pin fasteners, to a mating plate which is attached to the rear of the corrugated panel. The holding plate is removably connected to a conventional motion picture stand called a "Century Stand" designed to hold flags and cutters.

SUMMARY OF THE INVENTION

The invention generally comprises a portable fluorescent lighting system which is compact, lightweight and flexible for use on location in the field of photography, television and motion pictures. A significant feature of the invention is that the fluorescent lamp is powered by a remote ballast outside of the lighting system through a portable wire lamp harness utilizing a spring loaded locking lamp socket which maintains its support by clamping onto the lamp's electrodes, its bi-pin contacts. The portable wire lamp harness allows the lamp to operate independent of or outside of the fixture.

The corrugated plastic panel is made into five subpanels by removing two flutes of the corrugation to provide for hinging. Removal of the two flutes at each juncture of said subpanels provides for convenient and flexible hinging of the subpanels without adding any extra weight. By providing a wide hinging surface between panels the plastic is less likely to suffer material fatigue through constant manipulation, than if the flexing area were reduced to a narrow line. In order to prevent the subpanels from reverting back to their original positions after being flexed to a desired configuration, at each end of each subpanel an oval shaped channel is attached such that a deformable and a form retaining shaft having a circular cross section may be easily inserted and removed therein. Once a subpanel is manually positioned, the deformable and form retaining shafts will maintain the desired position. The oval channels are situated so as to maintain a displacement between each other which is equal to a gap not less than the width created by the removal of the flute material to form the hinge surface. The oval channel allows the form retaining shaft to flex over a broad area as much as a ½ inch between panels and channels. By preventing the form retaining shaft to flex at a specific focal point the potential stress and ensuing metal fatigue at that point is eliminated.

At least one fluorescent lamp is placed on the center subpanels wherein the other four subpanels are used to control or limit the output of the fluorescent light as well as act as an enclosure box.

In order to easily mount or hold the lighting system in place at any desired location and allow the system to be easily oriented in different directions, the lighting system utilizes a mounting device comprising a holding plate which consists of a ball and socket swiveling device to pivot and direct the position of the system. The holding plate is removably coupled, via a pair of "Nylatch" push-pin fasteners, to a mating plate which is attached to the rear of the center subpanel. The holding plate is mounted or held in place by a conventional motion picture stand called a "Century Stand" designed to hold flags and cutters.

It is therefore an object of the present invention to provide a portable lighting system for use on location in connection with photography, television and motion pictures.

It is another object of the present invention to provide a lighting system wherein the direction and degree of light illumination is flexibly and manually controlled.

Still another object of the present invention is to provide a locking lamp connector which is firmly attached to the lamp without the support of a fixture.

It is a further object of the present invention to provide a fluorescent lighting system which is extremely light and is powered through a remote ballast and portable wire lamp harness outside the system.

It is still yet another object of the present invention to provide a lighting system which can be fully enclosed upon its lighting source for easy storage and transportation.

It is yet another object of the present invention is to provide a lighting system which may be easily mounted or held in place at any desired location and can easily be oriented in several different directions.

An additional object of the present invention is to provide a lighting system which is inexpensive and simple to fabricate.

Further objects and novel features of the invention will become apparent from a reading of the following detailed descriptions, taken in conjunction with the drawings, in which a presently preferred embodiment of the invention is illustrated by way of example, forming a material part of this disclosure. It is to be understood, however, that the drawings are for the purpose of illustration and description only and are not intended as a definition of the limits of the invention.

BRIEF DESCRIPTION OF THE INVENTION

FIG. 3 is an elevational view of a cross section of a corrugated panel constituting the fixture, with two flutes removed for hinging purposes.

FIG. 4 is a partial perspective view of the corrugated panel, the oval channel and the form retaining shaft, shown in the disassembled form.

FIG. 5 is partial perspective view of the corrugated panel with the subpanels in angular position, and the oval channel and the form retaining shaft as attached to the subpanels.

FIG. 6 is a side elevational view of the lighting system in the folded configuration.

FIG. 11 is a rear perspective view of the lighting system showing the mounting device as attached to the rear of the lighting panel.

FIG. 12 is a top elevational view of the holding plate showing the ball and socket swivel device and the "Nylatch" fasteners.

FIG. 13 is a sectional view of the holding plate showing the ball and socket swiveling device, taken along line 13—13 of FIG. 12.

FIG. 14 is a sectional view of the "Nylatch" expandable fasteners, taken along line 14—14 of FIG. 12.

DETAILED DESCRIPTION OF THE INVENTION

Figure 1:
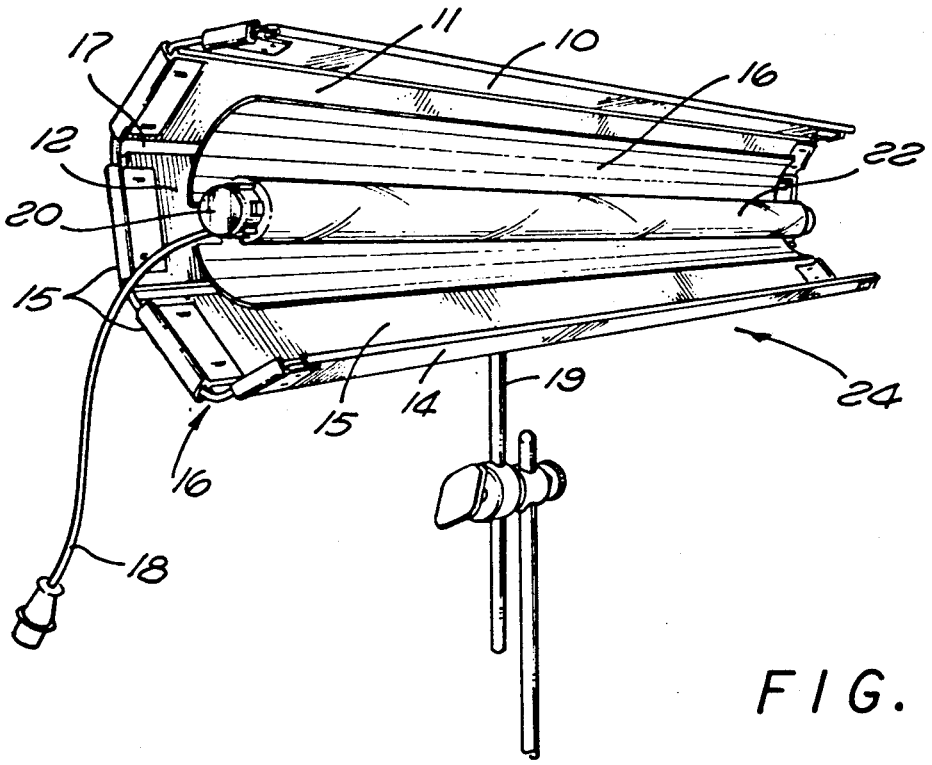
FIG. 1 is a perspective view of a fluorescent lighting system in accordance with the invention.

Referring to the figures in detail, FIG. 1 is a perspective view of the present invention. The invention comprises an elongate corrugated plastic panel 24, wherein said panel is made into five subpanels by removing two flutes 17 of the corrugation out to provide for hinging. The panel 24 includes center panel 12 at the center of said panel, a pair of inner subpanels 11 and 13 each on one side of center subpanel 12, outer subpanel 10 positioned on the outer side of inner subpanel 11, and outer subpanel 14 positioned on outer side of inner subpanel 13. All subpanels 10, 11, 13 and 14 are symmetrically positioned and longitudinally extending in parallel to center subpanel 12. Removal of two flutes 17 at each juncture of said subpanels provided for convenient and flexible hinging of subpanels without adding extra weight. In order to prevent the subpanels to revert back to their original positions after being flexed to a desired configuration, at each end of each subpanel a channel 15 in the shape of an oval is attached therein so that a deformable and form retaining shaft 16 having a substantially circular cross section may be easily inserted. Since shaft 16 is deformable, each subpanel can be manually positioned and held by the shaft in said position. Oval channel 15 allows for easy removal and replacement of shaft 16 such that in cases of metal fatigue, resulting in the shaft breakage, a new shaft can be inserted without having to replace the complete hinging mechanism or the lighting system itself.

In the preferred embodiment, center subpanel 12 is always twice the width of the outer subpanels 10 and 14. The fluorescent lighting source 22 is placed on the center subpanel 12. Inner subpanels 11 and 13 and outer subpanels 10 and 14 are used to control the direction of and limit the output of the fluorescent lighting source 22. Additionally, center subpanel 12 and inner subpanels 11 and 13 act as a reflective surface. A premolded aluminum reflective panel 21 could also optionally be added to act as a reflector panel.

Figure 2:
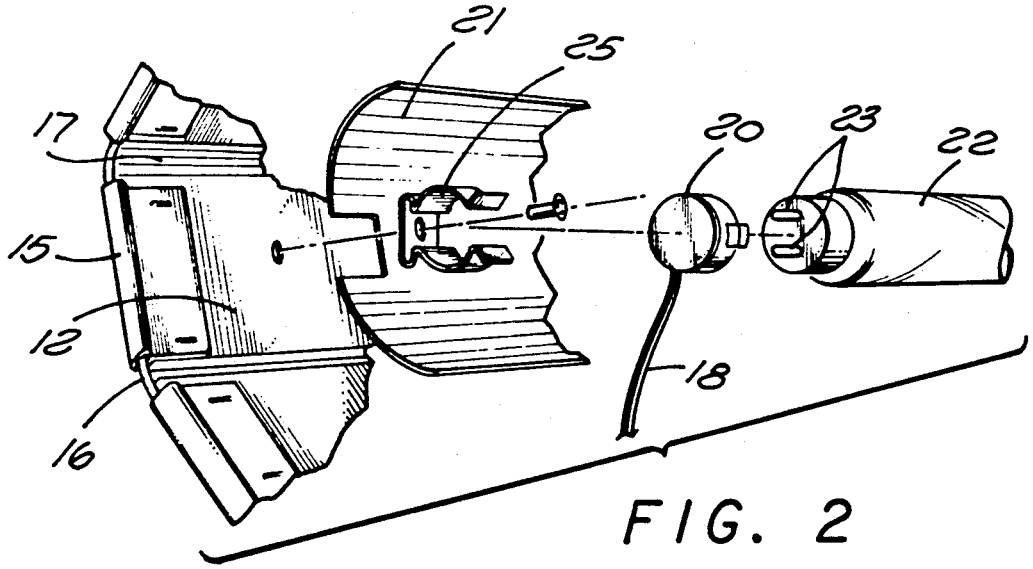
FIG. 2 is an exploded view of one end of the lighting system, showing the subpanels, the oval channel, the lamp bracket, and the locking lamp holder.
Figure 7:
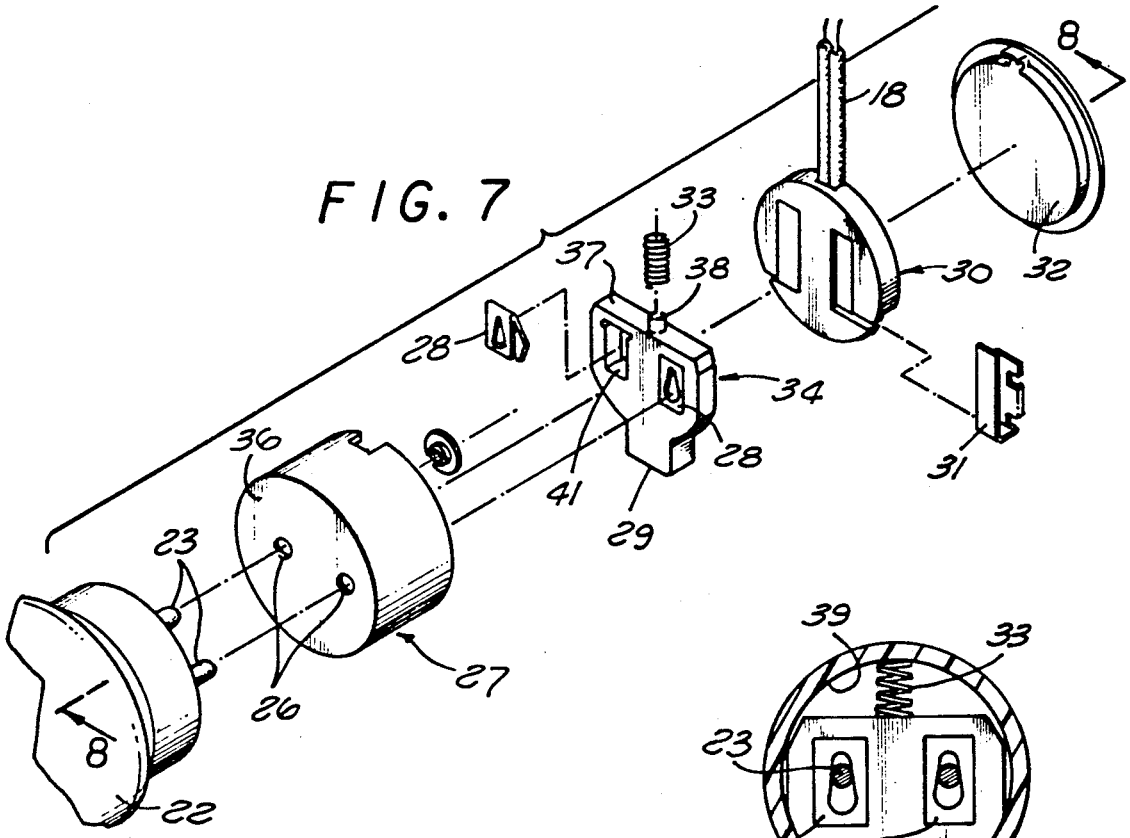
FIG. 7 is an exploded view of a disassembled locking lamp holder used to firmly hold onto a fluorescent tube as well as provid electrical power.

Referring now to FIG. 2, one end of the lighting system is shown. The lamp bracket 25, which is attached to the center subpanel 15, comprises a base and arcuate arm members made of resilient material to firmly hold each end of a fluorescent light in place. The pins 23 of the fluorescent light 22 are inserted into the spring loaded locking lamp holder 20, wherein the locking lamp holder 20 holds firmly onto the pins 22 and conducts electrical power to fluorescent light 22. Thereafter, the locking lamp holder 20 is inserted into the lamp bracket 25 which firmly holds the fluorescent light 22 in place.

In FIG. 3, the corrugated panel 24 is shown with two flutes 17 of corrugation removed for dividing the panel 24 into five subpanels as well as providing a hinge means for the subpanels.

As shown in FIGS. 4–5, the oval channels 15 are attached to the end of each subpanel providing for the form retaining and deformable shaft 16 to be easily inserted and removed for replacement purposes, wherein the deformable shaft 16 flexibly allows for the manual positioning of the subpanels in a desired position and prevents them from reverting back to a different configuration.

As shown in FIG. 6, all subpanels could be adjusted to completely enclose the lighting source in the form of a box for storage purposes and convenient transportation. A spring loaded locking lamp holder 20 firmly holds onto the pins 23 of the fluorescent light 22 and conducts electrical power to said fluorescent light. The spring loaded locking lamp holder 20 is described in more detail below.

Figure 9:
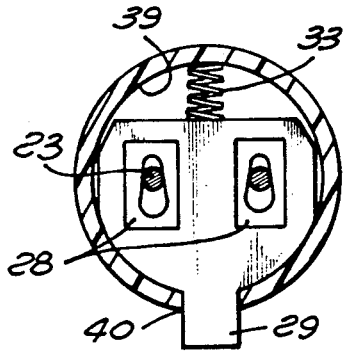
FIG. 9 is a sectional view of the locking lamp holder, taken along line 9—9 of FIG. 8.
Figure 8:
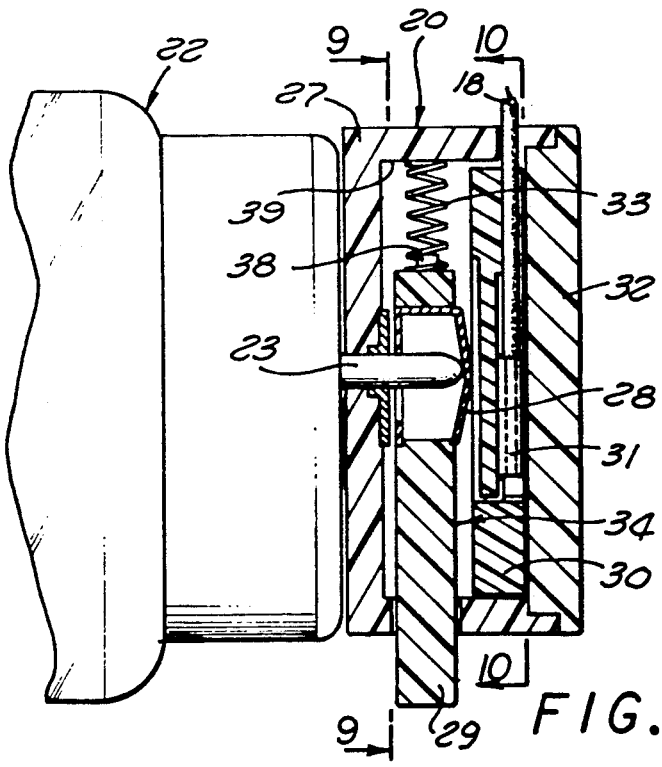
FIG. 8 is a sectional view of the locking lamp holder, taken along line 8—8 of FIG. 7.
Figure 10:
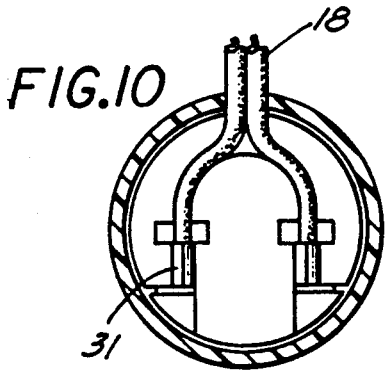
FIG. 10 is a sectional view of the locking lamp holder, taken along line 10—10 of FIG. 8.

Referring now to FIGS. 7–10, the spring loaded locking lamp comprises a cylindrical enclosure 27 made of plastic material which on the flat surface 36 has two round holes 26 corresponding to the size of the pins 23 of a fluorescent lamp 22; a pin holder 34 which is inserted in the enclosure 27 having a flat top and bottom and round edges so that it could move back and forth within the confines of the enclosure 27; the side 37 of the pin holder 34 is also flat with a protrusion 38 for placing a spring 33 between the pin holder side 37 and the round surface 39 of the enclosure as shown in FIGS. 8 and 9; the opposite side of the pin holder 29 is extended in the shape of a square or rectangular which protrudes from a slot 40 on the round surface of the enclosure 27. Pin holder 34 contains two rectangular holes 41, wherein pin holding elements 28 are inserted. Pin holding element 28 is a piece of conductive metal with a flat top and a V shape bottom. On the flat top of the pin holder element 28 is a slot, wherein at one end there is a large circle, corresponding to the size of the holes 26 on the enclosure box 27, which gradually decreases to a smaller circle at the other end; a circular switching element 30 is thereafter inserted into the enclosure 27. Switching element 30 has two electrical elements 31 which are connected to the electrical power cord 18; and cap 32 is inserted to completely cover the enclosure box 27.

The fluorescent light pins 23 are each inserted through the round holes 26 and at the same time by pressing the extended side 29 of the pin holder 34 allowing the large circles of the pin holding elements 28 to correspond to holes 26, thereby letting the pins 23 pass through and press down the V shape bottom of the pin holding element 28 and make contact with the electrical elements 31. After releasing the extended side 29 of the pin holder 34, the spring 33 will push the pin holder 34 back to its original place, providing for the small circles of the pin holding elements 28 to enclose the circumference of the pins 23 and to hold them firmly in place. The electrical power cord 18 is connected to a remote ballast located outside the lighting system.

FIG. 11 is a rear perspective view of the lighting system showing the mounting device used to mount or hold the lighting system in place. The mounting device comprises holding plate 42 which has a triangular plate 49 including socket 45 wherein a ball 44 is rotatably coupled with the socket 45. The ball 44 is welded into a stand rod 19 which in return is removably connected to a conventional motion picture stand 48 (not shown in full) called a "Century Stand" designed to hold flags and cutters. When a screw knob 47 on the triangular plate 49 is loose, the ball 44 can freely be swiveled about in the socket 45. Once the desired position of the ball 44 has been decided, the screw knob 47 is tightened to keep the ball 44 and the rod stand 19 firmly in place. The holder plate 42 is a modified "foam core holder plate" manufactured by American Studio Equipment of Sun Valley, Calif., part number ME96. The holder plate 42 is modified to accept a pair of "Nylatch expandable fasteners" 46, model number HN5-P-53-1 and HN5G-53-1. The holding plate 42 is removably attached via the Nylatch fasteners 46 to the mating plate 43 which is made of aluminium and is riveted to the rear of the center subpanel 12 using rivets 48, only one of which is shown. Preferably, a safety loop 50 is permanently attached to the mating plate with the rivet, into which a safety cable may be inserted to prevent the fixture from falling in the event any of the fixture supporting elements fail for any reason.

FIG. 12 is a top elevational view of the holding plate 42 showing the triangular plate 49 and the socket 45 wherein the ball 44 is rotatably coupled with the socket 45 and may be rotated freely within the socket 45 as described above.

FIG. 13 is a sectional view of the holding plate 42 taken along the line 13—13 of FIG. 12 as the holding plate 42 is attached to the mating plate 43. Tightening the screw knob 47 forces the triangular plate 49 to push against the ball 44 so as to keep the ball 44 firmly in the desired position.

In FIG. 14, the Nylatch dependable fastener 46 is shown connection the holding plate 42 to the mating plate 43.

What is claimed is:

1. A portable lighting system comprising:

a panel substantially rectangular having first and second ends, said panel having five subpanels including a center subpanel, a pair of inner subpanels symmetrically positioned on either side of and extending parallel to said center subpanel, and a pair of outer subpanels symmetrically positioned on either side of and extending parallel to said inner subpanels;

hinge means for pivoting each of said subpanels with respect to adjacent subpanels thereof such that said subpanels are capable of being folded to form an enclosure including at least one elongated fluorescent light source for transportation and storage purposes;

said at least one elongated fluorescent light source being positioned on said center subpanel;

a remote ballast means for illuminating said light source electrically connected to said light source through an electrical wire having a pre-determined length; and bracket means attached to said first and second ends of said center subpanel for holding said fluorescent light source in place.

2. A portable lighting system according to claim 1, wherein said panel is made of polypropylene corrugated plastic material having a plurality of flutes.

3. A portable lighting system according to claim 2, wherein said hinging means includes at least one flute of said corrugated plastic panel.

4. A portable lighting system according to claim 1, wherein the length of said panel is approximately two inches longer than the length of said light source.

5. A portable lighting system according to claim 1, wherein the width of said center subpanel is double the width of said outer subpanels.

6. A portable lighting system according to claim 1, wherein said illuminating means comprises:

(i) an electrical wire harness connected to said at least one light source;

(ii) a multiconductor cable connected to said remote ballast; and (iii) means for connecting said wire harness and said cable.

7. A portable lighting system according to claim 1, wherein said inner subpanels and said outer subpanels being movable to limit the light emitting from said light source.

8. A portable lighting system according to claim 1, wherein said bracket means comprises a base, having first and second ends, said first and second ends extending upwardly inward in relation to said base, further extending arcuately outward for encircling a substantial portion of said fluorescent light source and further flared outwardly for guiding said fluorescent light source into said bracket means.

9. A portable lighting system according to claim 1, further comprising a locking lamp connector for use in holding said fluorescent lamp without the support of a fixture and providing electrical current to said fluorescent light source having:

a cylindrical enclosure having a first and second flat ends, said first flat end having two holes on its surface corresponding to the shape and the size of a fluorescent lamp pins;

holding means within said cylindrical enclosure for holding onto said fluorescent lamp pins; and contact means within said cylindrical enclosure for making electrical contact with said fluorescent lamp pins.

10. A portable lighting system according to claim 9, wherein said holding means is spring loaded and self supporting by clamping onto lamp ends.

11. A portable lighting system according to claim 9, wherein said holding means is spring loaded.

12. A portable lighting system according to claim 9, wherein said contact means is part of said holding means.

13. A portable lighting system according to claim 1, further comprising holding means attached to a rear portion of said center subpanel for mounting and holding the lighting system in place as well as allowing said panel to be oriented in different directions.

14. A portable lighting system according to claim 13, wherein said holding means comprises:

(i) a holding plate having a mounting plate wherein two corners of said mounting plate are rotatably attached to the holding plate and one corner of said mounting plate is attached to the holding plate through a screw knob, the mounting plate having a socket substantially at its center;

(ii) a mating plate permanently attached to the rear of said center subpanel;

(iii) a pair of expandable fasteners for removably coupling said holding and mating plates; and (iv) an elongated stand rod having first and second ends, wherein said first end is in the shape of a ball and is rotatably coupled into said socket and said second end is removably coupled to a stand.

15. A portable lighting system according to claim 14, wherein said holding plate is an articulated plate.

16. A portable lighting system according to claim 1 wherein said illuminating means comprises:

i) a portable electric wire harness connected to said at least one light source;

ii) a multiconductor cable connected to said remote ballast; and iii) means for connecting said wire harness and said cable.

17. A locking lamp connector for use in holding a fluorescent lamp without the support of a fixture and providing electrical current to said fluorescent lamp comprising:

a cylindrical enclosure having a first and second flat ends, said first flat end having two holes on its surface corresponding to the shape and size of a fluorescent lamp pins;

holding means within said cylindrical enclosure for holding onto said fluorescent lamp pins; and contact means within said cylindrical enclosure for making electrical contact with said fluorescent lamp.

said holding means disposed between said cylindrical enclosure and said contact means, said holding means including a pin holder having holes into which first and second pin holding elements are inserted, each of said pin holding elements having a slot with first and second ends, with a first width formed at said first end and a second width formed at said second end such that said first width is smaller than said second width, each said slot being adapted to hold one of the fluorescent lamp pins within said first width of said first end, wherein the size of said first width is adapted to firmly hold one of said fluorescent lamp pins.

18. A locking lamp connector according to claim 17, wherein said pin holder is spring loaded.

19. A locking lamp connector according to claim 17, wherein said contact means is part of said holding means.

20. A locking lamp connector according to claim 17, wherein said holding means is spring loaded and self supporting by clamping onto the lamp electrodes or pins.

21. A portable lighting system comprising:

a panel substantially rectangular having first and second ends, said panel having a plurality of subpanels, one of said plurality of subpanels being a center subpanel;

hinge means for pivoting each said subpanel with respect to adjacent subpanels, said hinge means comprising at least one channel attached to said panel's first and second ends, said channel forming an oval shape such that a deformable and form retaining shaft having a substantially circular cross-section may be inserted into said channel for the purpose of flexibility and manually altering and maintaining said subpanels in any desired configuration such that said subpanels are capable of being folded to form an enclosure including at least one elongated fluorescent light source for transportation and storage purposes;

said at least one elongated fluorescent light source being positioned on said center subpanel;

a remote ballast means for illuminating said light source electrically connected to said light source through an electrical wire having a pre-determined length; and bracket means attached to said first and second ends of said center subpanel for holding said fluorescent light source in place.

22. A portable lighting system according to claim 21, wherein said panel is made of polypropylene corrugated plastic material having a plurality of flutes.

23. A portable lighting system according to claim 22, wherein said hinging means includes at least one open flute of said corrugated plastic panel.

24. A portable lighting system according to claim 21, wherein the length of said panel is approximately two inches longer than the length of said light source.

25. A portable lighting system according to claim 21, wherein said panel comprises five subpanels including a center subpanel, a pair of inner subpanels symmetrically positioned on either side of and extending parallel to said center subpanel, and a pair of outer subpanels symmetrically positioned on either side of and extending parallel to said inner subpanels.

26. A portable lighting system according to claim 25, wherein the width of said center subpanel is double the width of said outer subpanels.

27. A portable lighting system according to claim 25, wherein said inner subpanels and said outer subpanels are used to limit the light emitting from said light source.

28. A portable lighting system according to claim 17, wherein said illuminating means comprises:

(i) an electrical wire harness connected to said at least one light source;

(ii) a multiconductor cable connected to said remote ballast; and (iii) means for connecting said wire harness and said cable.

29. A portable lighting system according to claim 21, wherein said bracket means comprises a base, having first and second ends, said first and second ends extending upwardly inward in relation to said base, further extending arcuately outward for encircling a substantial portion of said fluorescent light source and further flared outwardly for guiding said fluorescent light source into said bracket means.

30. A portable lighting system according to claim 21, further comprising a locking lamp connector for use in holding said fluorescent light source without the support of a fixture and providing electrical current to said fluorescent light source having:

a cylindrical enclosure having a first and second flat ends, said first flat end having two holes on its surface corresponding to the shape and size of a fluorescent lamp pins;

holding means within said cylindrical enclosure for holding onto said fluorescent lamp pins; and contact means within said cylindrical enclosure for making electrical contact with said fluorescent lamp pins.

31. A portable lighting system according to claim 30, wherein said holding means is spring loaded.

32. A portable lighting system according to claim 30, wherein said contact means is positioned adjacent said holding means.

33. A portable lighting system according to claim 21, further comprising holding means attached to a rear portion of said center subpanel for mounting and holding the lighting system in place as well as allowing said panel to be oriented in different directions.

34. A portable lighting system according to claim 33, wherein said holding means comprises:

(i) a holding plate having a mounting plate wherein two corners of said mounting plate are rotatably attached to the holding plate and one corner of said mounting plate is attached to the holding plate through a screw knob, the mounting plate having a socket substantially at its center;

(ii) a mating plate permanently attached to the rear of said center subpanel;

(iii) a pair of expandable fasteners for removably coupling said holding and mating plates; and (iv) an elongated stand rod having first and second ends, wherein said first end is in the shape of a ball and is rotatably coupled into said socket and said second end is removably coupled to a stand.

35. A portable lighting system according to claim 34, wherein said holding plate is an articulated plate.

36. The system defined by claim 17 further comprising a wire harness attached to a cylindrical enclosure which is not coupled to said fixture.

37. A portable lighting system comprising:

a panel substantially rectangular having first and second ends, said panel having five subpanels including a center subpanel, a pair of inner subpanels by symmetrically positioned on either side of and extending parallel to said center subpanel, and a pair of outer subpanels symmetrically positioned on either side of and extending parallel to said inner subpanels;

hinge means for pivoting each said subpanel with respect to adjacent subpanels, said hinge means comprising at least one channel attached to said panel's first and second ends, said channel forming an oval shape such that a deformable and form retaining shaft having a substantially circular cross section may be inserted into said channel for the purpose of flexibility and manually altering and maintaining said subpanels in any desired configuration;

oval channels situated so as to maintain a displacement between each other which is equal to a gap not less than the width created by the removal of the flute material to form a hinge surface;

a loose fitting formable wire adapted to flex over an area between the oval channels;

formable wire is loose fitting allowing it to be easily replaced;

at least one elongated fluorescent light source positioned on said center subpanel;

a remote ballast means for illuminating said light source electrically connected to said light source through an electrical wire having a pre-determined length;

a portable wire lamp harness unattached to the panels holding the locking lamp connector; and bracket means attached to said first and second ends of said center subpanel for holding said fluorescent light source in place.

* * * * *

UNITED STATES PATENT AND TRADEMARK OFFICE

CERTIFICATE OF CORRECTION

PATENT NO. : 5,132,885

DATED : July 21, 1992

INVENTOR(S) : Hocheim et al.

It is certified that error appears in the above-identified patent and that said Letters Patent is hereby corrected as shown below:

Title page, item [57],
In the Abstract at the 21st line delete "protable" and insert --portable--.

In column 1 at line 47 between "requiring" and "of" insert --space--.

In column 4 at line 5 delete "provid" and insert --provide--.

Signed and Sealed this

Twentieth Day of June, 1995

*Attest:*

Bruce Lehman

BRUCE LEHMAN

*Attesting Officer*

*Commissioner of Patents and Trademarks*